US006575837B1

(12) United States Patent
Weske et al.

(10) Patent No.: US 6,575,837 B1
(45) Date of Patent: Jun. 10, 2003

(54) FENCING SCORING APPARATUS AND SYSTEM

(76) Inventors: Timothy J. Weske, 12235 Spring Trail, Lake View Terrace, CA (US) 91342; Steven Leroy Karman, 1911 Walcott Way, Los Angeles, CA (US) 90039

( * ) Notice: Subject to any disclaimer, the term of this patent is extended or adjusted under 35 U.S.C. 154(b) by 72 days.

(21) Appl. No.: 09/891,946

(22) Filed: Jun. 26, 2001

(51) Int. Cl.[7] ..... A63B 69/02
(52) U.S. Cl. ..... 463/47.1; 482/12
(58) Field of Search ..... 463/47.1, 47.4, 463/47.2, 51–53, 57; 482/12, 84; 434/11, 19, 21–22, 247; 446/473; 273/317

(56) References Cited

U.S. PATENT DOCUMENTS

| | | | | |
|---|---|---|---|---|
| 2,916,287 A | * | 12/1959 | Davey | 463/47.1 |
| 3,920,242 A | | 11/1975 | Reith et al. | |
| 4,030,731 A | | 6/1977 | Delcayre | |
| 4,254,951 A | | 3/1981 | De Laney | |
| 4,299,386 A | | 11/1981 | Kulesza et al. | |
| 4,616,933 A | | 10/1986 | Lévêque et al. | |
| 4,917,500 A | | 4/1990 | Lugos | |
| 5,537,212 A | | 7/1996 | Kelly et al. | |
| 5,537,213 A | | 7/1996 | Seim et al. | |
| 5,553,860 A | | 9/1996 | Zelikovich | |
| 5,802,607 A | | 9/1998 | Triplette | |
| 5,836,853 A | | 11/1998 | Marciano | |
| 2001/0023218 A1 | * | 9/2001 | Marciano | 482/12 |
| 2002/0077223 A1 | * | 6/2002 | Zai | 482/83 |

FOREIGN PATENT DOCUMENTS

| | | | |
|---|---|---|---|
| FR | 2611512 | * | 9/1988 |
| JP | 5-261168 | * | 10/1993 |
| JP | 7-88214 | * | 4/1995 |
| SU | 673285 | * | 7/1979 |

* cited by examiner

*Primary Examiner*—John A. Jeffery
(74) *Attorney, Agent, or Firm*—Luedeka, Neely & Graham, P.C.

(57) ABSTRACT

An apparatus is provided for use in a fencing game. The apparatus contains optical electronics disposed in an internal space. The optical electronics operate to emit light, detect optical signals and provide electrical signals corresponding to detected optical signals. A transmitter is provided for transmitting the electrical signals to a first location for displaying a number of touches obtained by a user of the apparatus. The apparatus includes a blade attached to the handle having a base portion coupled to the optical electronics, a translucent tip portion, and a conduit between the base portion and the translucent tip, for conveying light between the translucent tip portion and the optical electronics.

17 Claims, 4 Drawing Sheets

FENCING SCORING APPARATUS AND SYSTEM

FIELD OF THE INVENTION

The present invention is generally directed to gaming devices and methods for their use. More particularly, the invention is directed to a fencing apparatus and methods for using the same.

BACKGROUND

Fencing is a sport premised on the use of a weapon, e.g. foil, sword, epee, saber, etc., which the fencer wields to "score" points against his/her opponent. The fencing bout or match pits one fencer against another. The outcome of the fencing bout is determined according to a predetermined number of first touches inflicted with the weapon's tip by one opponent against his/her adversary. Various areas on each fencer's body produce a "score" when touched with the weapon tip or the blade, when using a saber. Each fencing tournament utilizes a predetermined amount of required scoring touches in determining the winner of a fencing contest.

Fencing tournaments involve a number of contestants who are matched against one another in various rounds until one fencer defeats all others and is crowned the champion. Each fencing tournament has its own scoring procedures and rules for deciding what constitutes a scoring touch. For example, one scoring system utilizes what are called "line judges". It is necessary to have four people, one person for each comer of the "strip" (the fencer's area of play). The scoring is entirely subjective, since the judges rely on their eyes to see the touches. If four people are not available, it is left to one "judge" who observes the fencing bout and decides whether one opponent achieves a scoring touch against his/her opponent. This type of scoring system is not very accurate or fair since the scores are determined subjectively.

Attempts have been made to circumvent the subjective standard of the above described fencing scoring system, by "automating" the scoring determination, thereby adding a degree of objectiveness to scoring touches achieved during a fencing bout. However, attempts in automating the scoring determination of a fencing bout have resulted in less-than-ideal equipment prone to malfunction, leading to inaccurate scoring results and lengthy downtime while the fencer attempts to "fix" any malfunctioning fencing equipment. Furthermore, the current automated equipment used in fencing bouts is bulky, non-robust, and limits a fencer's maneuverability.

Therefore, a fencing apparatus is needed that overcomes the disadvantages of the current fencing systems.

SUMMARY OF THE INVENTION

In accordance with the invention, a fencing apparatus is provided for use in a fencing game. The fencing apparatus includes a handle having an internal space, wherein optical electronics are disposed. The optical electronics operate to emit light, detect optical signals and provide electrical signals corresponding to detected optical signals. The apparatus also includes a power source which provides power to the optical electronics and the transmitter for transmitting the electrical signals to a first location. A blade is attached to the handle having a base portion coupled to the optical electronics, a translucent tip portion, and a conduit disposed between the base portion and the translucent tip. The conduit being operable to convey light between the translucent tip portion and the optical electronics.

In another aspect, a fencing scoring system is provided for compiling game points obtained by a user during a fencing contest. The fencing scoring system includes an apparatus for a user to wield during the contest. The apparatus includes a handle having an internal space wherein optical electronics are disposed. The optical electronics being operable to emit light, detect optical signals and provide electrical signals corresponding to detected optical signals. The apparatus also includes a blade attached to the handle, the blade including a base portion coupled to the optical electronics, a translucent tip portion, and a conduit located between the base portion and the translucent tip portion, for conveying light between the translucent tip portion and the optical electronics. The scoring system also includes a transmitter for transmitting the electrical signals to a first location, a power source for providing power to the optical electronics and transmitter, a receiving unit for receiving the electrical signals transmitted by the transmitter, and a display device in electrical communication with the receiving unit for displaying whether a point has been scored by the user.

In yet another aspect, the invention provides fencing equipment for use by fencers in a fencing game. The fencing equipment includes at least one colored target disposed on a target area of each fencer. Each fencer wields a weapon having handle, wherein optical electronics are adjacently disposed. The optical electronics are operable to emit light, detect optical signals and provide electrical signals corresponding to detected optical signals. The fencing equipment also includes a transmitter for transmitting the electrical signals to a first location and a power source for providing power to the optical electronics and transmitter. The weapon further includes a blade attached to the handle having a base portion coupled to the optical electronics and a distal portion for contacting a colored target disposed on a fencer. A conduit is located between the base portion and the distal portion, which conveys light between the distal portion and the optical electronics.

According to the invention, a system is provided allowing multiple players to participate in any number of swordplay or fencing games, without having a restricted range of movement due to external cables coupled to a floor reel.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 1:
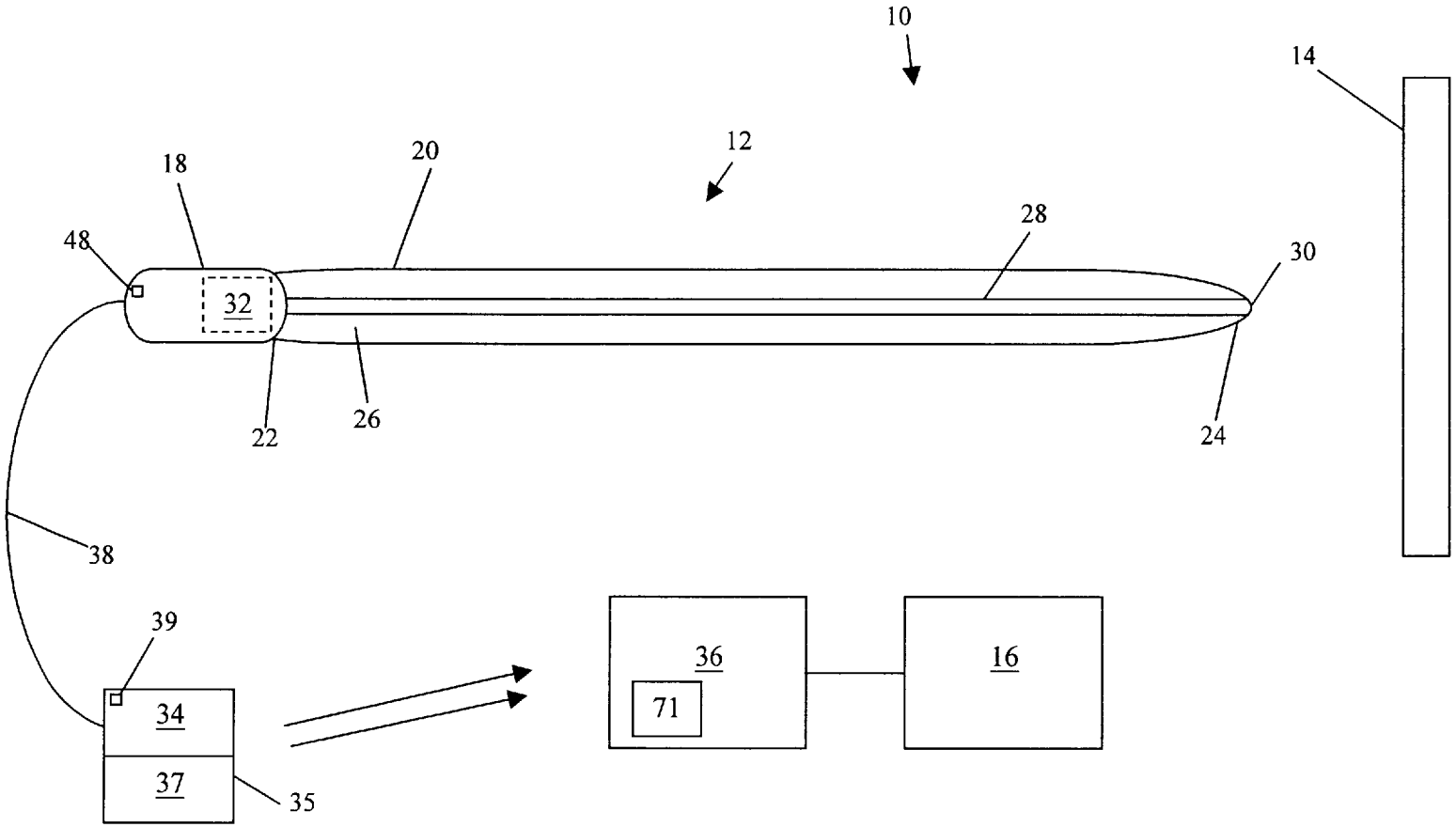
FIG. 1 is a schematic diagram of the fencing scoring system in accordance with a preferred embodiment of the invention.

As shown in FIG. 1, a fencing scoring system 10 is provided for scoring a swordplay or fencing game. According to the invention, it is possible to keep track of the number of touches achieved by one or more players during a game. Games utilize any number of weapon types including, but are not limited to, foil, epee, saber, etc. The invention can accommodate any number of game players. The system 10 includes an apparatus 12 for each player to wield during a game. Each player preferably wears a black uniform, including at least one color target area 14. A scoreboard or display 16 is utilized to tally the number of touches registered by each player according to the color touched with the apparatus 12.

According to the invention, preferably no cables are required to provide communication between the apparatus 12 and the display 16 of the system 10. Thus, the system 10 enables the players to have an unlimited range of mobility during a game. The apparatus 12 is preferably of substantially the same weight and appearance as an actual competition weapon, such as a foil, epee, or saber, etc. The apparatus 12 includes a handle 18, which resembles the hilt or grip of a weapon. Releasably connected to the handle 18 is an elongate member 20, which resembles a blade of a weapon. The elongate member 20 has a first end 22 and a second end 24, and is preferably constructed from steel. The elongate member 20 also contains a bore 26, which preferably houses one or more fiber optic lines 28. In the preferred embodiment, the fiber optic line 28 traverses the entire length of the elongate member 20, from the second end 24 to the first end 22. Preferably, the second end 24 of the elongate member 20 encapsulates a lens member 30. Preferably, the lens member is a convex type lens constructed of plastic, having a diameter of between about ⅛ inch and about ¼ inch. Alternatively, the fiber optic line 28 can be equipped with a lens member 30.

In the preferred embodiment of the invention, the handle 18 of the apparatus 12 houses optical electronics 32 (FIG. 2) in the form of a chip. Each player also wears an attachable box 35, preferably at a belt location, which houses a wireless transmitter 34 and a power source 37, preferably a rechargeable nickel cadmium battery, for providing power to the transmitter 34 and the optical electronics 32. The wireless transmitter 34 is preferably a frequency modulated (FM) transmitter. In the preferred embodiment, a direct cable link 38 is used to connect the transmitter 34 to the optical electronics 32, providing power thereby. Alternatively, the handle 18 can house a mini-transmitter, power supply 33 (FIG. 3), and antenna for transmitting signals from the apparatus 12 to the box 35, for ultimate transmission to the receiver 36 and display 16. It will be appreciated that the apparatus 12 and box 35 can include additional or less components and the invention is not intended to be limited by the specific examples and embodiments detailed herein. Furthermore, the apparatus 12 and the box 35 can be described generally as the weapon which each player uses during a fencing match.

Figure 2:
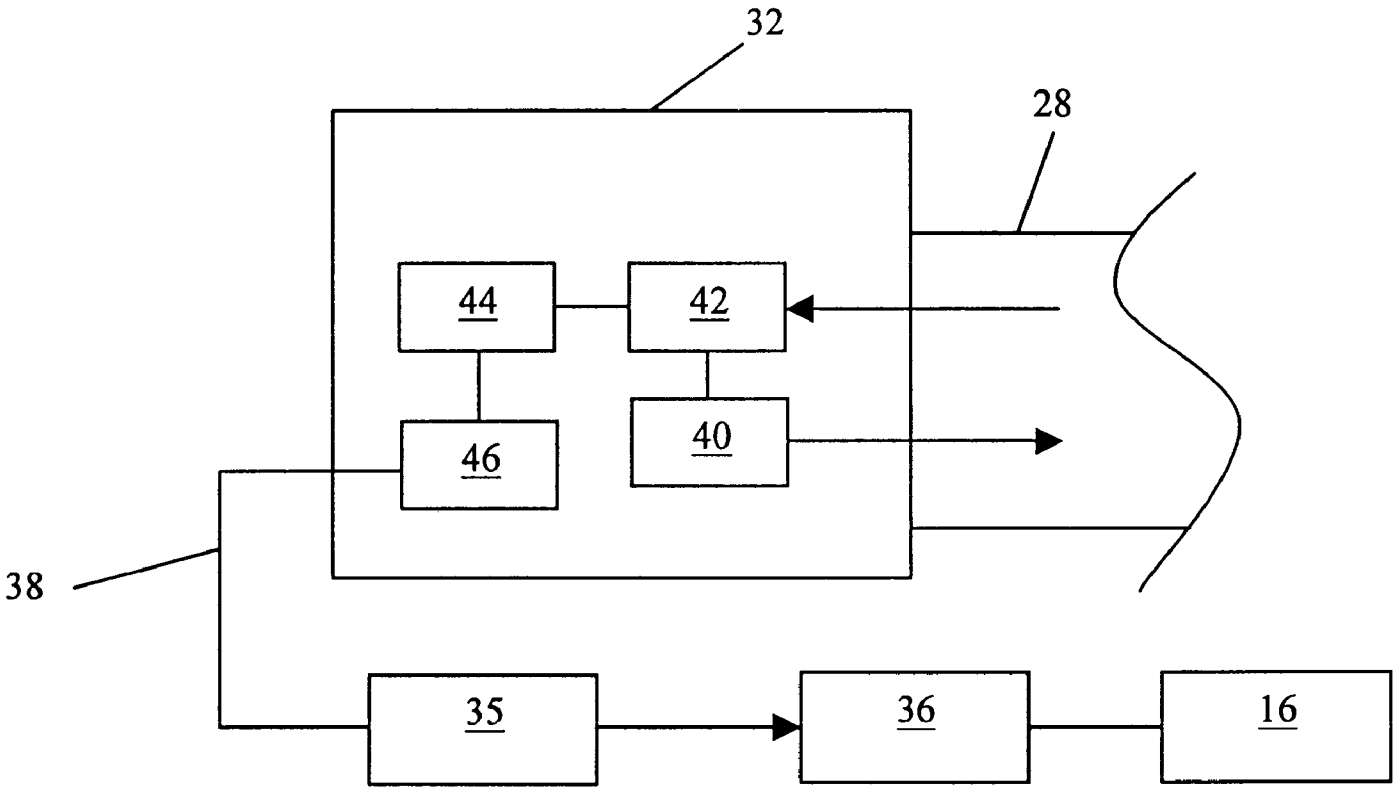
FIG. 2 is a functional block diagram of the electronics of the fencing scoring system according to a preferred embodiment of the invention.

With additional reference to the block diagram of FIG. 2, a preferred embodiment of the optical electronics 32 and transmission circuitry is shown. The optical electronics 32 preferably include a light emitter 40, an optical filter 42, a photodetector 44, and a driver 46. The light emitter 40 is preferably a light emitting diode (LED) white light source operable to transmit white light conveyed by the fiber optic line 28 and out of the translucent lens member 30.

The box 35 includes an off/on switch 39 for enabling the transmitter 34 and providing power to the optical electronics 32 via the direct cable link 38. The handle 18 of the apparatus 12 is preferably equipped with an off/on switch 48 (FIG. 1), which when switched to the "on" position, allows power to be provided from the power source 37 the optical electronics 32.

Correspondingly, when the handle switch 48 is in the "on" position, power is provided to the optical electronics 32. As a result, the light emitter 40 emits light which is conveyed by the fiber optic line 28 and emitted out of the lens member 30. When a player touches the lens member 30 of the apparatus 12 against a target 14 located on the uniform of another player, light is reflected from the target 14 and conveyed by the fiber optics 38 to the optical filter 42 of the optical electronics 32. Preferably, the optical filter 42 is a red, blue or green filter. The optical filter 42 is operable to pass reflected light having frequencies within the passband of the optical filter 42. Accordingly, when an opponent is touched with the apparatus 12 in an area having a color which reflects a frequency in the passband of the optical filter 42, the optical signals pass through the filter 42. Thus, light signals having frequencies within the passband of the optical filter 42 are passed to the photodetector 44.

The photodetector 44 produces an analog electrical signal when impinged upon by the light passed by the optical filter 42. As shown in FIG. 2, driver electronics 46 amplify the electrical signal produced by the photodetector 44 before transmission by the direct cable link 38 to the box 35. Once the amplified signal reaches the box 35, the transmitter 34 transmits the signal to a remote location, where the receiver 36 receives the signal and outputs the received signal to the display 16. The box 35 preferably includes a frequency selectable transmitter 34, so that each player may set the transmitter 34 to a different operating frequency. In this manner, the receiver 36 is able to distinguish one player's touch (transmission) from another. Accordingly, the receiver 36 is selectively enabled to receive the corresponding transmission frequencies of the transmitter 34. Additionally, the receiver 36 or alternatively, the display 16 includes processing electronics, including a microprocessor 71. Accordingly, the microprocessor 71 can be configured by software or firmware functions, to incorporate rules of different games. For example, one function of the microprocessor 71 can enable the receiver 36 to block a subsequent touch (transmission) when a first touch has already occurred. It is preferred that the receiver 36 and the display 16 are incorporated into a single unit.

The preferred display 16 will incorporate four lights which are located on a front side of the display 16. The receiver 36 upon receipt of a transmission from a player generates a signal which is sent to the display 16. Depending on the type of hit, on-target or off-target, the display 16, via the four lights, indicates whether a point has been scored and by which player. For example, the four lights may include, from left to right on the display 16, a white light, red light, green light and second white light. The red light, when lit, is indicative of a scoring touch achieved by player one and the green light, when lit, is indicative of a scoring touch achieved by player two. Similarly, for a particular game, the white lights are indicators of off-target touches by a respective player. It is also preferred that the display 16 and/or receiver 36 include a mechanism for determining the type of scores to be indicated. The mechanism can be in the form of a button, switch or dial and when actuated, configures the receiver 36 and display 16 for the rules of a particular game. For example, the mechanism can be configured to score a foil, epee or saber match. When foil is selected, all of the lights are operable to score on and off target touches by each player. When the epee or saber is selected, only the colored lights are operable, since off target scores are not tabulated. It will be appreciated that variations of the display 16 and the receiver 36 can include more or less indicators and internal circuitry and can be provisioned according to each particular game.

As an example of this preferred embodiment, for two players in a fencing game, each player wears a uniform, preferably black, which includes a colored target area 14. The color of the target area 14 corresponds to the passband frequency of the optical filter 42. Each player switches on the apparatus 12 and the box 35, with the switches 48 and 39. Once the components have been turned on, the transmission frequencies of each player's transmitter 34 are adjusted, so that the each transmitter 34 is transmitting at a different coded set of frequencies. Depending on the type of transmitter 34, different types of encoding are available. For example, manual "dip switches" can be used to encode each transmitter 34. Also, each apparatus 12 can be electrically connected to a central computer, wherein the computer electrically encodes each transmitter 34 to have different transmission frequencies. The receiver 36 is likewise adjusted to receive each player's transmission frequencies, thus discriminating touches of each player.

As the game begins, each player wields the respective apparatus 12, attempting to touch the target area 14 of the opponent. As the players spar, white light is being transmitted from the lens 30 of the apparatus by the light emitter 40, illuminating the area of the uniform that is touched. As one opponent touches the other opponent in the colored target area 14, light having the wavelength of the color touched is transmitted back through the fiber optic line 28 to the optical filter 42. Since the optical filter 42 has a passband which includes the touched target color, light passes through the filter 42 and impinges upon the photodetector 44. In response, the photodetector 44 outputs an analog electric signal to the driver 46. The driver 46 amplifies the signal, and the direct cable link 38 provides the amplified signal to the box 35, which houses the transmitter 34. The transmitter 34, operating at the player's selected frequency, transmits the amplified signal to the receiver 36. The received signal is output to the display 16, displaying that a point has been scored by the player. As described above, for this embodiment, it is also preferred that the receiver 36 includes processing electronics which operate to block the other player's reception should he touch the target area 14 shortly after the first touch. Preferably, the channel remains blocked for a selected period of time, automatically resetting before the players begin a second round of fencing.

Figure 3:
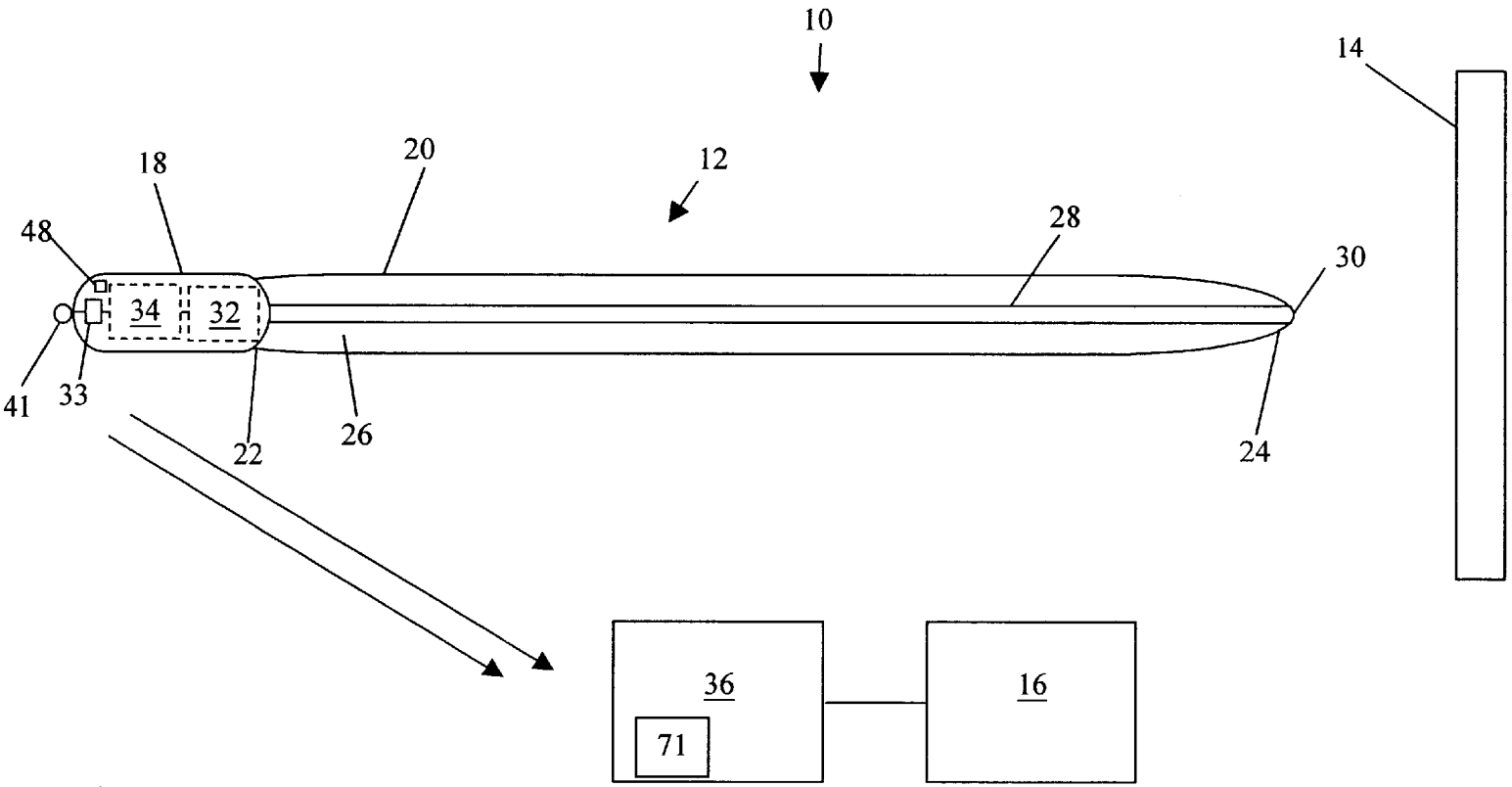
FIG. 3 is a schematic diagram of the fencing scoring system in accordance with another embodiment of the invention; and, FIG. 4 is a functional block diagram of the electronics of the fencing scoring system in accordance with another embodiment of the invention.

In an alternative embodiment of the invention, as shown in FIG. 3, the handle 18 includes the transmitter 34 and an antenna 41 for directly transmitting scoring signals to the receiver 36 which is electrically connected to the display 16. Preferably, antenna 41 is located at the base of the handle 18, so that the antenna 41 does not inhibit the user's handling of the weapon. The transmitter 34 is located adjacent to the optical electronics 32 to reduce the amount of electrical wiring and power driving requirements to electrically connect the transmitter 34 to the optical electronics 32. For this embodiment, it is preferred that the handle include an internal power source for providing power to the transmitter 34 and optical electronics 32.

Figure 4:
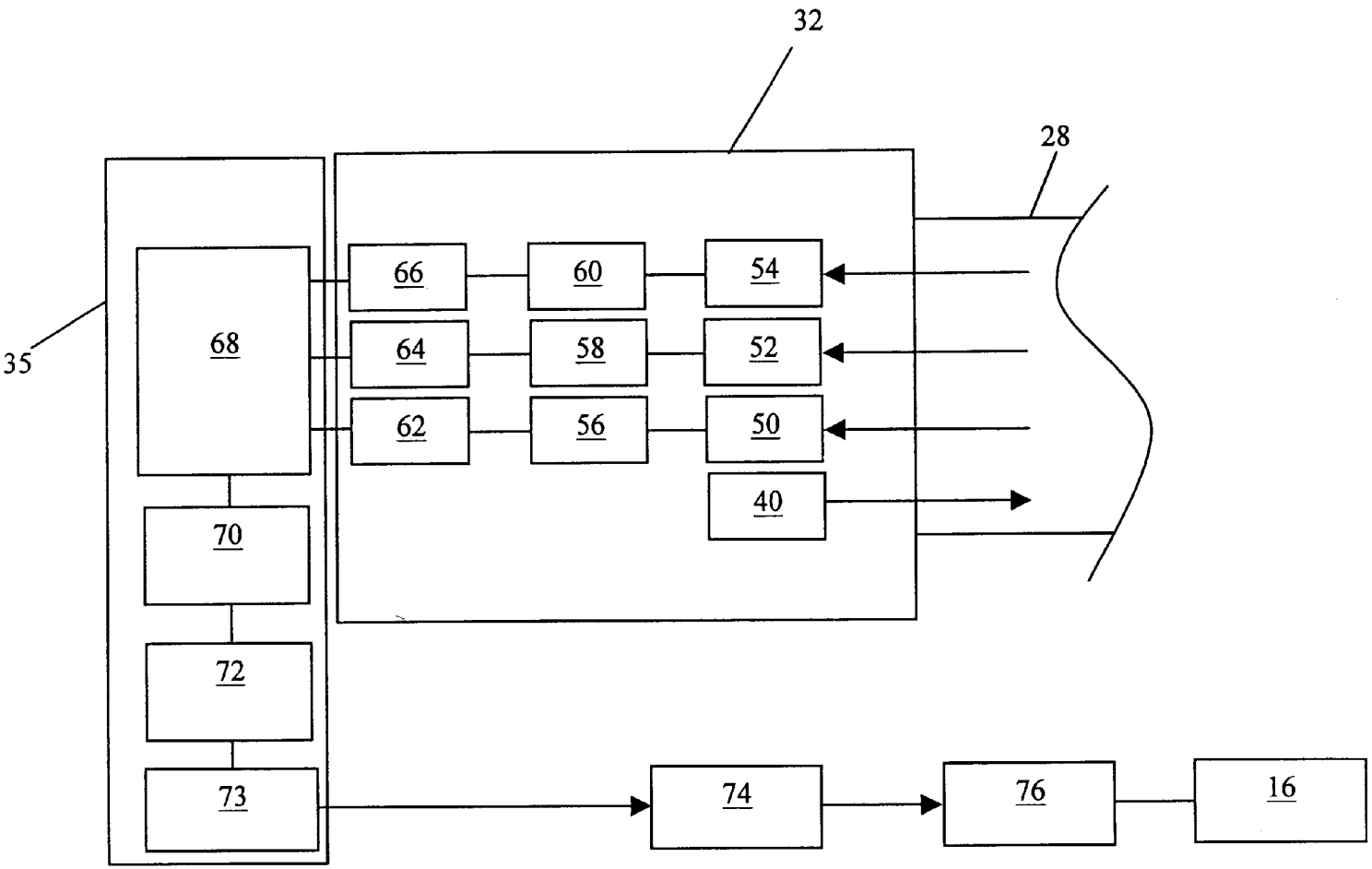

In yet another embodiment of the invention, as shown in FIG. 4, the optical electronics 32 of the apparatus 12 include a plurality of optical filters 50, 52 and 54, each having a passband corresponding to a different color frequency. Each filter 50–54 is coupled to a separate photodetector 56, 58 and 60 and drivers 62, 64, and 66. According to this embodiment of the invention, a black uniform worn by each opponent includes multiple target areas, each having a different color, such as red, etc., which include wavelengths in correspondence with the passbands of the optical filters 50–54. As described below, each color provides a different score when touched by the apparatus 12. The drivers 62–66 provide touch signals output from the photodetectors 56–60 to an analog-to-digital converter 68. The analog-to-digital converter 68 converts the analog signals to a digital representation, and the digital signals are output to a microprocessor 70 for further processing.

The microprocessor 70 encodes the signals depending on which filter 50–54 passed an optical signal. The encoded signal corresponds to a score determined by which color was touched by the apparatus 12, and passed by the corresponding optical filter 50–54. The encoded signal is output by the microprocessor 70 to a digital-to-analog converter 72 and is transmitted by the transmitter 73 to an analog-to-digital pre-stage 74 at the receiver location. The receiver 76 includes microprocessing features which are operable to decode the signal output from the analog-to-digital pre-stage 74. Based on the decoded signal, the receiver 76 outputs a signal to the display 16 corresponding to the number of points scored according to the color touched.

Alternatively, the microprocessor 70 can be configured to provide a score signal to the digital-to-analog converter 72. That is, based on the color touched, the microprocessor 70 determines the score, which after conversion is transmitted by the transmitter 73 to the analog-to-digital pre-stage 74 and receiver 76. Furthermore, the microprocessor 70 is preferably operable to tally a number of touches before providing an output signal to indicate a tallied score.

Examples provided above are in no way intended to limit the scope of the invention accordingly numerous modification are available. Thus, other games can be devised using the apparatus 12, wherein the box 35 includes various settings according to the type of game desired. For example, a game using an epee-type weapon can be implemented, wherein only a first hit provides a score. For this game, a point (score) is also awarded to each player is a simultaneous touch.

It is contemplated, and will be apparent to those skilled in the art from the preceding description and the accompanying drawings that modifications and/or changes may be made in the embodiments of the invention. For example, the players of each game can adorn uniforms having colors other than black. Additional circuitry is provided in the optical electronics to discriminate different color uniforms. For example, for a white uniform having separate colored target areas, additional discriminating circuitry is included operable to determine when the white portion of the uniform is touched and thereby not awarding a point or score. The discriminating circuitry determines that more than one color has been returned from a touch, indicating a non-target area and no score. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. An apparatus for use in a fencing game comprising:

a handle having an internal space, optical electronics disposed in the internal space, the optical electronics operable to emit light, detect optical signals and provide electrical signals corresponding to detected optical signals, a transmitter for transmitting the electrical signals to a first location, a power source for providing power to the transmitter and optical electronics, a blade attached to the handle having:
a base portion coupled to the optical electronics,
a translucent tip portion, and
a conduit between the base portion and the translucent tip, the conduit for conveying light between the translucent tip portion and the optical electronics.

2. The apparatus of claim 1 wherein the conduit comprises one or more optical fibers operable to transmit and receive light.

3. The apparatus of claim 1 wherein the transmitter is a frequency modulated transmitter.

4. The apparatus of claim 1 wherein the blade and handle are of a size and appearance that is structurally similar in weight and appearance to the structure of a foil, epee, or saber.

5. The apparatus of claim 1 wherein the optical electronics further comprise:
a light emitter coupled to the conduit,
an optical filter coupled to the conduit for passing optical signals received from the conduit having frequencies within a passband of the optical filter, and
a photodetector optically coupled with the optical filter for receiving the optical signals passed by the optical filter and generating corresponding electrical signals based thereon.

6. The apparatus of claim 1 wherein the optical electronics include a red optical filter operable to pass optical signals having frequencies within a red passband spectrum.

7. The apparatus of claim 1 wherein the optical electronics include a blue optical filter operable to pass optical signals having frequencies within a blue passband spectrum.

8. The apparatus of claim 1 wherein the optical electronics include a green optical filter operable to pass optical signals having frequencies within a green passband spectrum.

9. A fencing scoring system for compiling game points scored by a user during a fencing contest, comprising:
an apparatus for a user to wield during the contest, including:
a handle having an internal space,
optical electronics disposed in the internal space, the optical electronics operable to emit light, detect optical signals and provide electrical signals corresponding to detected optical signals,
a transmitter for transmitting the electrical signals to a first location,
a power source for providing power to the optical electronics and transmitter,
a blade attached to the handle having:
a base portion coupled to the optical electronics,
a translucent tip portion, and
a conduit between the base portion and the translucent tip portion, the conduit for conveying light between the translucent tip portion and the optical electronics,
a receiving unit at the first location for receiving the electrical signals transmitted by the transmitter, and
a display device in electrical communication with the receiving unit for displaying whether a point has been scored by the user.

10. The system of claim 9 wherein the optical electronics further comprise:
a light emitter,
an optical filter for passing optical signals received from the conduit having frequencies within a passband of the optical filter, and
a photodetector optically coupled with the optical filter for receiving the optical signals passed by the optical filter and generating the corresponding electrical signals based thereon.

11. The system of claim 10 further comprising:
processing electronics including:
driver circuitry for amplifying the electrical signals provided by the photodetector,
a first microprocessor in communication with the driver circuitry for operating on the electrical signals to generate output signals indicative of whether one or more game points have been scored by the user of the apparatus, and
the transmitter further for transmitting the output signals to the receiving unit.

12. The system of claim 11 wherein the receiving unit further comprises:
a second microprocessor for accepting and processing the transmitted signals and for outputting a scoring signal indicative of whether one or more points have been scored by the user of the apparatus.

13. The system of claim 9 further comprising:
a light emitter,
a plurality of optical filters for passing optical signals received from the conduit having frequencies within corresponding passbands of the optical filters,
a plurality of photodetectors, each optically coupled with a corresponding one of the optical filters, each for receiving optical signals passed by the corresponding optical filter and generating corresponding electrical signals based thereon, and processing electronics including:
a microprocessor for accepting and processing the electrical signals to output signals indicative of whether one or more points have been scored by the user of the apparatus.

14. An apparatus for use by a fencer in a fencing game comprising:
a base housing,
optical processing components disposed within the base housing for detecting optical signals and providing electrical signals when the optical signals have a wavelength corresponding to a color in the visible spectrum,
a transmitter including an antenna for transmitting the electrical signals to a remote location,
a power source for providing power to the optical processing components and transmitter, and
an elongate member releasably connected to the base housing, the elongate member operable to transmit and receive optical signals, and provide the optical signals to the optical processing components.

15. Fencing equipment for use by fencers in a fencing game comprising:
at least one colored target disposed on each fencer,
a weapon including:
a handle,
optical electronics disposed adjacent the handle, the optical electronics operable to emit light, detect optical signals and provide electrical signals corresponding to detected optical signals,
a transmitter for transmitting the electrical signals to a first location,
a power source for providing power to the optical electronics and transmitter,
a blade attached to the handle having:
a base portion coupled to the optical electronics,
a distal portion for contacting the at least one colored target disposed on one of the fencers, and a conduit between the base portion and the distal portion, the conduit for conveying light between the distal portion and the optical electronics.

16. The fencing equipment of claim 15 wherein the optical electronics further comprise:

a light emitter, an optical filter for passing optical signals received from the conduit having frequencies within a passband of the optical filter, and a photodetector optically coupled with the optical filter for receiving the optical signals passed by the optical filter and generating corresponding electrical signals based thereon.

17. A method of scoring a fencing match between players armed with weapons and clothed in uniforms having at least one colored target thereon, each weapon comprising a handle, optical electronics disposed adjacent to the handle, a transmitter, and a blade having a base portion, a distal portion, and a conduit for conveying light between the base and distal portions, the method comprising the steps of:

emitting light signals with the optical electronics through the conduit of at least one of the weapons, receiving light signals with the at least one of the weapons when the distal portion of the blade contacts the uniform of an opposing one of the players, determining with the optical electronics a wavelength of the light signals received by the at least one of the weapons, transmitting a signal to a display when a selected wavelength is determined by the optical electronics of the at least one of the weapons, and displaying a score with the display based on the transmitted signal.

* * * * *